US009256144B2

(12) United States Patent
Okada et al.

(10) Patent No.: US 9,256,144 B2
(45) Date of Patent: Feb. 9, 2016

(54) ELECTROPHOTOGRAPHIC PHOTOSENSITIVE MEMBER AND IMAGE FORMING APPARATUS

(71) Applicant: KYOCERA Document Solutions Inc., Osaka (JP)

(72) Inventors: Hideki Okada, Osaka (JP); Keiji Maruo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/444,101

(22) Filed: Jul. 28, 2014

(65) Prior Publication Data

US 2015/0037069 A1 Feb. 5, 2015

(30) Foreign Application Priority Data

Jul. 31, 2013 (JP) ..... 2013-158852

(51) Int. Cl.
*G03G 5/05* (2006.01)
*G03G 5/06* (2006.01)
*G03G 15/00* (2006.01)

(52) U.S. Cl.
CPC ..... *G03G 5/0629* (2013.01); *G03G 5/0564* (2013.01); *G03G 5/0614* (2013.01); *G03G 5/0696* (2013.01); *G03G 15/00* (2013.01)

(58) Field of Classification Search
CPC ..... G03G 5/0521; G03G 5/0517
See application file for complete search history.

(56) References Cited

U.S. PATENT DOCUMENTS 6,383,698 B1 * 5/2002 Okada ..... G03G 5/047 430/56

FOREIGN PATENT DOCUMENTS

JP H01-230054 A 9/1989
JP 2005-173292 A 6/2005

OTHER PUBLICATIONS

An Office Action; "Notice of Reasons for Rejection," issued by the Japanese Patent Office on Jul. 21, 2015, which corresponds to Japanese Patent Application No. 2013-158852 and is related to U.S. Appl. No. 14/444,101.

* cited by examiner

*Primary Examiner* — Hoa V Le
(74) *Attorney, Agent, or Firm* — Studebaker & Brackett PC

(57) ABSTRACT

An electrophotographic photosensitive member containing a terphenoquinone derivative represented by the following formula (1):

(1)

wherein $R^1$ to $R^5$ may be the same or different and each represent a hydrogen atom, an alkyl group having 1 to 12 carbon atoms, an aryl group having 6 to 12 carbon atoms and optionally having an alkyl group having 1 to 12 carbon atoms, an aralkyl group having 6 to 12 carbon atoms, a cycloalkyl group having 3 to 10 carbon atoms, or an alkoxy group having 2 to 6 carbon atoms.

8 Claims, 3 Drawing Sheets

ELECTROPHOTOGRAPHIC PHOTOSENSITIVE MEMBER AND IMAGE FORMING APPARATUS

INCORPORATION BY REFERENCE

The present application claims priority under 35 U.S.C. §119 to Japanese Patent Application No. 2013-158852, filed Jul. 31, 2013. The contents of this application are incorporated herein by reference in their entirety.

BACKGROUND

The present disclosure relates to electrophotographic photosensitive members containing a specific terphenoquinone derivative and image forming apparatuses including an electrophotographic photosensitive member.

Organic photosensitive members and inorganic photosensitive members are known as electrophotographic photosensitive members to be included in image forming apparatuses. An organic photosensitive member contains a binder resin, a charge generating material, a hole transport material, and an electron transport material. An inorganic photosensitive member contains an inorganic material such as amorphous silicon. As compared with the inorganic photosensitive member, the organic photosensitive member is more easily produced and have higher degree of freedom in structural design as having more options for materials of the photosensitive member.

In order to form high-quality images using an image forming apparatus having an organic photosensitive member, there is a strong need for materials contained in the organic photosensitive member to have sufficient sensitivity characteristics.

However it is difficult for the electron transport material used in the organic photosensitive member, among the materials contained in the organic photosensitive member, to show sufficient sensitivity characteristics. It is therefore contemplated to obtain an electron transport material capable of sufficiently improving the sensitivity characteristics of the organic photosensitive member.

SUMMARY

An electrophotographic photosensitive member of the present disclosure contains a terphenoquinone derivative represented by the following formula (1):

(1)

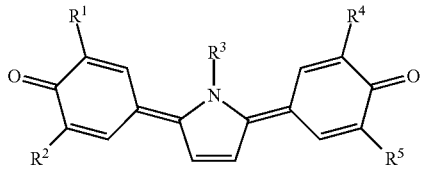

wherein $R^1$ to $R^5$ may be the same or different and each represent a hydrogen atom, an alkyl group having 1 to 12 carbon atoms, an aryl group having 6 to 12 carbon atoms and optionally having an alkyl group having 1 to 12 carbon atoms, an aralkyl group having 6 to 12 carbon atoms, a cycloalkyl group having 3 to 10 carbon atoms, or an alkoxy group having 2 to 6 carbon atoms.

An image forming apparatus of the present disclosure includes an image bearing member, a charger configured to charge a surface of the image bearing member, an exposure device configured to expose the surface of the image bearing member charged to form an electrostatic latent image on the surface of the image bearing member, a developing device configured to develop the electrostatic latent image into a toner image, and a transfer device configured to transfer the toner image from the image bearing member to a material to be transferred. The image bearing member corresponds to the electrophotographic photosensitive member of the present disclosure.

DETAILED DESCRIPTION

Figure 1A:
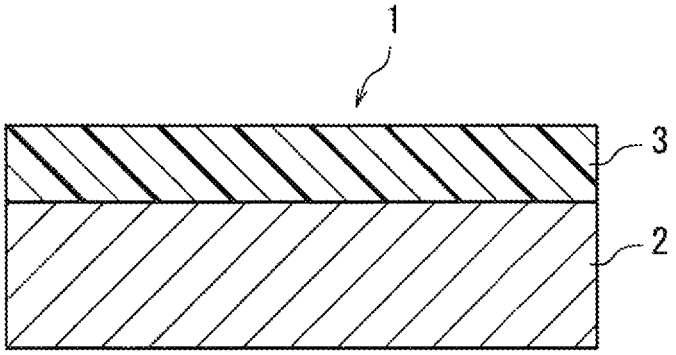
FIG. 1A is a schematic cross sectional view showing a structure of an electrophotographic photosensitive member of the present disclosure.

Hereinafter, the present disclosure will be described in detail. The present disclosure is not limited thereto.

An electrophotographic photosensitive member according to an embodiment of the present disclosure contains a specific terphenoquinone derivative represented by the following formula (1). Such a terphenoquinone derivative can function as an electron transport material in an electrophotographic photosensitive member.

(1)

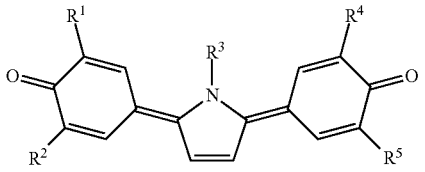

In the formula (1), $R^1$ to $R^5$ may be the same or different and each represent a hydrogen atom, an alkyl group having 1 to 12 carbon atoms, an aryl group having 6 to 12 carbon atoms and optionally having an alkyl group having 1 to 12 carbon atoms, an aralkyl group having 6 to 12 carbon atoms, a cycloalkyl group having 3 to 10 carbon atoms, or an alkoxy group having 2 to 6 carbon atoms.

An electrophotographic photosensitive member including a specific terphenoquinone derivative containing a pyrrole ring as represented by the formula (1) has improved electron mobility. The electrophotographic photosensitive member can therefore have significantly excellent sensitivity (photosensitivity). A specific example of the sensitivity will be described in detail in Examples. Since the nitrogen atom in the pyrrole ring has the substituent $R^3$, the terphenoquinone derivative has several advantages including excellent compatibility with the later-described binder resin when used in an electrophotographic photosensitive member as described later.

Examples of the alkyl group having 1 to 12 carbon atoms include a methyl group, an ethyl group, an i-propyl group, a t-butyl group, a pentyl group, a hexyl group, a heptyl group, an octyl group, a nonyl group, a decyl group, an undecyl group, and a dodecyl group.

Examples of the aryl group having 6 to 12 carbon atoms include a phenyl group, a naphthyl group, and a biphenyl group. The aryl group may further have an alkyl group having 1 to 12 carbon atoms. Examples of such an aryl group include a (o-, m-, and p-)tolyl group, a (o-, m-, and p-)cumenyl group, a 2,3-xylyl group, and a mesityl group. The number and substitution position of the alkyl group substituted in the aryl group are not particularly limited.

Examples of the aralkyl group having 6 to 12 carbon atoms include a benzil group and a phenethyl group.

Examples of the cycloalkyl group having 3 to 10 carbon atoms include a cyclopropyl group, a cyclobutyl group, a cyclopentyl group, a cyclohexyl group, a cycloheptyl group, a cyclooctyl group, a cyclononyl group, and a cyclodecyl group.

Examples of the alkoxy group having 2 to 6 carbon atoms include an ethoxy group, a propoxy group, a butoxy group, a pentoxy group, and a hexoxy group.

In particular, in order to improve the sensitivity characteristics, $R^1$, $R^2$, $R^4$, and $R^5$ are preferably the same, and are preferably an alkyl group having 1 to 12 carbon atoms. In addition, from a viewpoint of the compatibility with the later-described binder resin, $R^3$ is preferably an alkyl group having 1 to 12 carbon atoms. As such a combination of $R^1$, $R^2$, $R^3$, $R^4$, and $R^5$, the following may be mentioned. For example, $R^1$, $R^2$, $R^4$, and $R^5$ are a t-butyl group, and $R^3$ is a methyl group; $R^1$ to $R^5$ are a methyl group; $R^1$, $R^2$, $R^4$, and $R^5$ are a methyl group, and $R^3$ is an ethyl group; $R^1$, $R^2$, $R^4$, and $R^5$ are a methyl group, and $R^3$ is an octyl group; $R^1$, $R^2$, $R^4$, and $R^5$ are a t-butyl group, and $R^3$ is a phenyl group; or $R^1$, $R^2$, $R^4$, and $R^5$ are a t-butyl group, and $R^3$ is a benzil group.

A method for synthesizing the terphenoquinone derivative represented by the formula (1) will be described in detail using following Reaction Formulae (I) to (IV).

Reaction Formula (I)

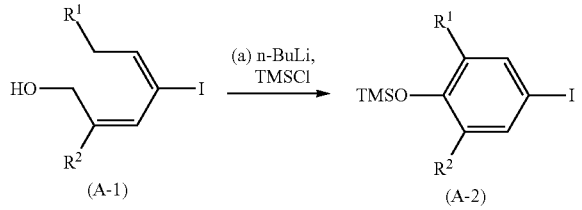

Reaction Formula (II)

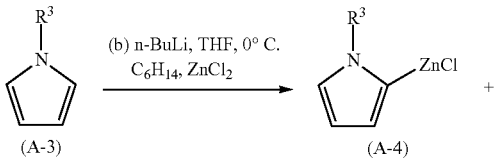

-continued

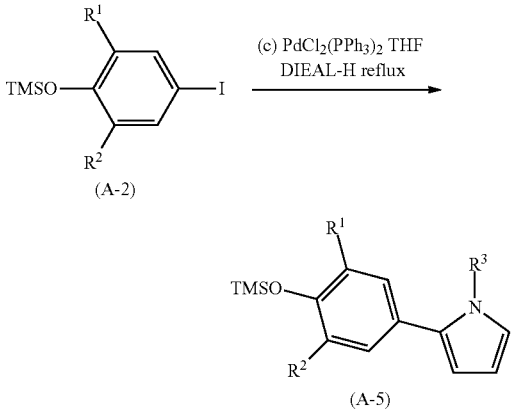

Reaction Formula (III)

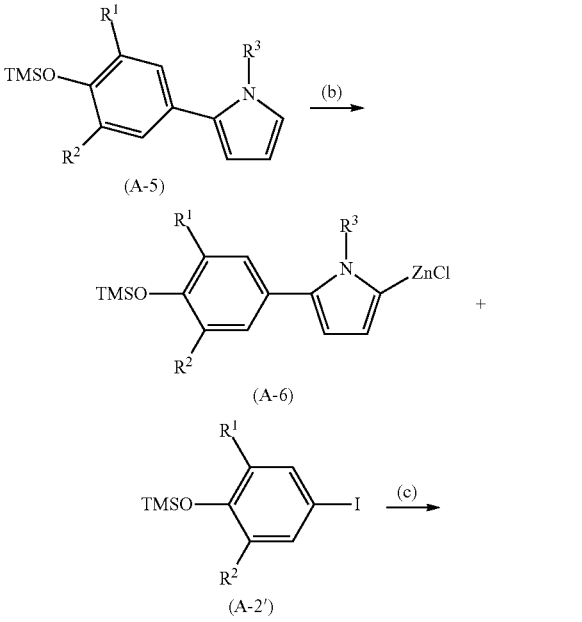

Reaction Formula (IV)

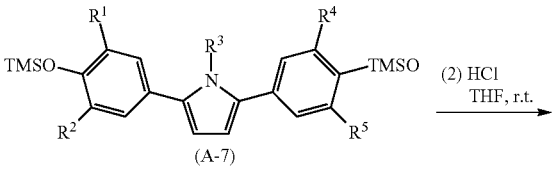

-continued

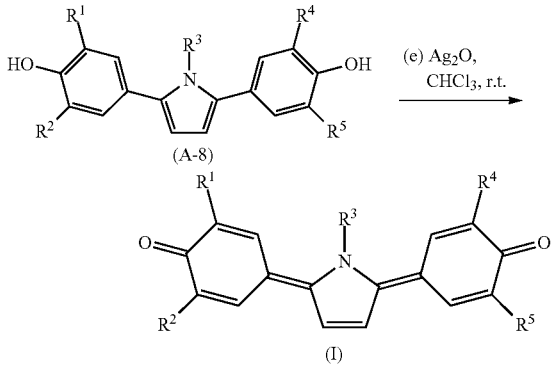

$R^1$ to $R^5$ represent the substituents as described above in Reaction Formulae (I) to (IV). n-BuLi represents n-butyllithium. TMS represents a trimethylsilyl group. THF represents tetrahydrofuran. $PdCl_2(PPh_3)_2$ represents a bistriphenylphosphine-palladium chloride complex. DIBAL-H represents diisobutylaluminum hydride.

Reactions (a) to (e) in Reaction Formulae (I) to (IV) correspond to descriptions regarding the later-described reactions.

Reaction Formula (I) will be described.

First, a 4-iodophenol derivative (A-1) having substituents $R^1$ and $R^2$ at the 2-position and 6-position, respectively, is prepared as a starting material. Then, in the reaction (a), the derivative (A-1) is reacted with trimethylsilylchloride (TMSCl) under cooling in the presence of n-butyllithium. Thus, a compound (A-2) in which a hydroxyl group has been substituted with a trimethylsilyl group as a protective group is obtained.

Reaction Formula (II) will be described.

Subsequently, a tetrahydrofuran solution of a pyrrole ring (A-3) having the substituent $R^3$ at the 3-position is cooled to 0° C. in the reaction (b). Then, a hexane solution of n-butyllithium and zinc chloride are added for a reaction to give a compound (A-4). Furthermore, diisobutylaluminum hydride and a bistriphenylphosphine-palladium chloride complex are used to produce zero-valent palladium as an activated species in the reaction (c). Then, the compound (A-4) and the compound (A-2) are reacted by reflux or the like in the presence of the palladium to give a tetrahydrofuran solution of a compound (A-5).

Reaction Formula (III) will be described.

The thus obtained tetrahydrofuran solution of the compound (A-5) is reacted with a hexane solution of n-butyllithium and zinc chloride by the same method as described in the reaction (b) to give a compound (A-6). Furthermore, the compound (A-6) and a compound (A-2') are reacted using diisobutylaluminum hydride and a bistriphenylphosphine-palladium chloride complex by the same method as described in the reaction (c) to give a tetrahydrofuran solution of a compound (A-7). The compound (A-2') is obtained by the same method as described in Reaction Formula (I) except that $R^1$ and $R^2$ of the compound (A-1) are changed to $R^4$ and $R^5$, respectively.

Reaction Formula (IV) will be described.

The thus obtained tetrahydrofuran solution of the compound (A-7) is reacted with an excess amount of concentrated hydrochloric acid at room temperature (r.t.) and extracted with chloroform to give a crude product (A-8) in which the protective group (trimethylsilyl group) has been eliminated. The crude product (A-8) is oxidized with an excess amount of silver oxide at room temperature, purified by a silica gel column or the like, and then recrystallized from chloroform. Thus, the terphenoquinone derivative represented by the formula (1) contained in the electrophotographic photosensitive member of the present disclosure is obtained.

[Electrophotographic Photosensitive Member]

An electrophotographic photosensitive member of the present disclosure contains the terphenoquinone derivative represented by the formula (1). The electrophotographic photosensitive member of the present disclosure has significantly excellent sensitivity characteristics. The use of the electrophotographic photosensitive member of the present disclosure in an image forming apparatus can therefore allow formation of high-quality images. In particular, the electrophotographic photosensitive member of the present disclosure can be understood as an electrophotographic photosensitive member including a conductive substrate and a photosensitive layer containing the terphenoquinone derivative. Being of a positively chargeable type, the electrophotographic photosensitive member may be referred to as positively chargeable electrophotographic photosensitive member or positively chargeable photosensitive member.

In terms of the structure, the electrophotographic photosensitive member of the present disclosure may be a so-called single-layer photosensitive member or multi-layer photosensitive member. A charge generating material, a hole transport material, an electron transport material, and a binder resin are contained in a single layer (photosensitive layer) in the single-layer photosensitive member. A multi-layer photosensitive layer including a charge generating layer and a charge transport layer is formed on a conductive substrate in the multi-layer photosensitive member. The charge generating layer contains a charge generating material and a binder resin. The charge transport layer contains an electron transport material, a hole transport material, and a binder resin.

Compared with the multi-layer photosensitive member, the single-layer photosensitive member can achieve formation of higher-quality images. Furthermore, the photosensitive layer of the single-layer photosensitive member has a simpler structure and is more easily produced, and therefore occurrence of a film defect can be reduced. Hereinafter, reasons why the single-layer photosensitive member has the above-mentioned advantages will be specifically explained.

First, the photosensitive layer of the single-layer photosensitive member has a simpler structure and is more easily produced than that of the multi-layer photosensitive member. By contrast, at least two layers need to be formed for producing the multi-layer photosensitive member, and therefore the production process thereof can be laborious.

Hereinafter, an example of the electrophotographic photosensitive member of the present disclosure will be described with reference to FIG. 1. An electrophotographic photosensitive member 1 has a single-layer photosensitive layer. The electrophotographic photosensitive member 1 includes a conductive substrate 2 and a photosensitive layer 3 (single-layer photosensitive layer). The photosensitive layer 3 is provided on the conductive substrate 2 as a single layer containing the terphenoquinone derivative represented by the formula (1) as an electron transport material, a charge generating material, a hole transport material, and a binder resin. For example, the photosensitive layer 3 may be provided directly on the conductive substrate 2 as shown in FIG. 1A. Alternatively, an appropriate intermediate layer 4 may be provided between the conductive substrate 2 and the photosensitive layer 3 as shown in FIG. 1B.

Figure 1B:
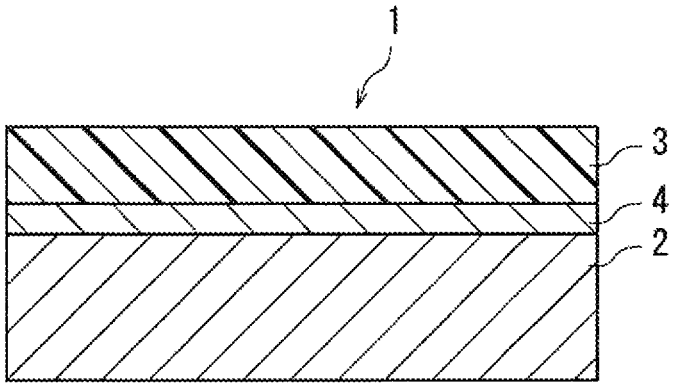
FIG. 1B is a schematic cross sectional view showing another structure of the electrophotographic photosensitive member of the present disclosure.
Figure 1C:
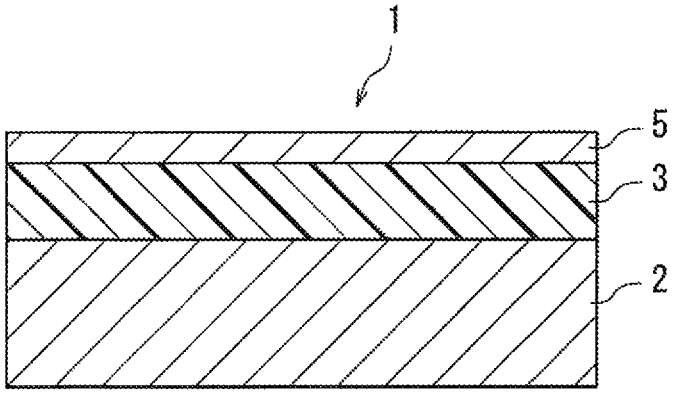
FIG. 1C is a schematic cross sectional view showing another structure of the electrophotographic photosensitive member of the present disclosure.

The photosensitive layer 3 may be uncovered as an outermost layer as shown in FIGS. 1A and 1B. Alternatively, a protective layer 5 may be provided on the photosensitive layer 3 as appropriate as shown in FIG. 1C.

[Conductive Substrate]

Various conductive materials can be used as the conductive substrate. Examples of the materials of the conductive substrate include elementary metal substances (e.g., iron, aluminum, copper, tin, platinum, silver, vanadium, molybdenum, chromium, cadmium, titanium, nickel, palladium, indium, stainless steel, or brass); plastic materials prepared by depositing or laminating the above-mentioned metal; and glass coated with aluminum iodide, tin oxide, or indium oxide.

The conductive substrate may take the form of a sheet or a drum depending on the structure of the image forming apparatus to which the conductive substrate is applied. Furthermore, it is sufficient that the conductive substrate itself or a surface of the conductive substrate is conductive. In addition, the conductive substrate preferably has a sufficient mechanical strength when in use.

[Photosensitive Layer]

The photosensitive layer may contain the terphenoquinone derivative represented by the formula (1), a charge generating material, a hole transport material, and a binder resin. The terphenoquinone derivative represented by the formula (1) is contained in the photosensitive layer and acts as an electron transport material, which is one of charge transport materials.

The photosensitive member may contain only the terphenoquinone derivative represented by the formula (1) as the electron transport material or contain another electron transport material in combination with the terphenoquinone derivative.

Examples of the electron transport material that may be contained in combination with the terphenoquinone derivative represented by the formula (1) include naphthoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride.

The charge generating material is not particularly limited as long as it can be used as a charge generating material in an electrophotographic photosensitive member. Specific examples thereof include powders of organic photoconductive materials (e.g., X-form metal-free phthalocyanine (x-$H_2$Pc), Y-form titanyl phthalocyanine (Y—TiOPc), perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, pyrylium salts, anthanthrone based pigments, triphenylmethane based pigments, threne based pigments, toluidine based pigments, pyrazoline based pigments, or quinacridone based pigments); and powders of inorganic photoconductive materials (e.g., selenium, selenium-tellurium, selenium-arsenic, cadmium sulfide, or amorphous silicon). One of the charge generating materials may be used alone, or two or more of the charge generating materials may be used in combination, selected as appropriate so as to have an absorption wavelength within a desired range.

In particular, image forming apparatuses employing a digital optical system (e.g., laser beam printers and facsimile machines each employing a semiconductor laser or the like as the light source) need a photosensitive member having a sensitivity in a wavelength range of 700 nm or longer. Of the above-mentioned charge generating materials, therefore, phthalocyanine based pigments (metal-free phthalocyanine such as X-form metal-free phthalocyanine or Y-form titanyl phthalocyanine) are preferably used, for example, for such image forming apparatuses.

In the case of image forming apparatuses including a short-wavelength laser light source having wavelengths within a range of 350 nm to 550 nm, an anthanthrone based pigment or a perylene based pigment can be used as the charge generating material.

The hole transport material is not particularly limited as long as it can be used as a hole transport material to be contained in a photosensitive layer of an electrophotographic photosensitive member. As the hole transport material, nitrogen-containing cyclic compounds and condensed polycyclic compounds are preferred. Examples of the hole transport material that can be preferably used include N,N,N',N'-tetraphenylbenzidine derivatives, N,N,N',N'-tetraphenylphenylenediamine derivatives, N,N,N',N'-tetraphenylnaphtylenediamine derivatives, and N,N,N',N'-tetraphenylphenantolylenediamine derivatives; oxadiazole based compounds such as 2,5-di(4-methylaminophenyl)-1,3,4-oxadiazole; styryl based compounds such as 9-(4-diethylaminostyryl)anthracene; carbazole based compounds such as polyvinyl carbazole; organopolysilane compounds; pyrazoline based compounds such as 1-phenyl-3-(p-dimethylaminophenyl)pyrazoline; hydrazone based compounds; indole based compounds; oxazole based compounds; isoxazole based compounds; thiazole based compounds; thiadiazole based compounds; imidazole based compounds; pyrazole based compounds; and triazole based compounds. These hole transport materials may be used alone, or two or more of these hole transport materials may be used in combination.

Various resins usable for the photosensitive layer can be used as the binder resin. Examples thereof include thermoplastic resins (styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, alkyd resin, polyamide, polyurethane, polycarbonate resin, polyallylate, polysulfone, diallyl phthalate resin, ketone resin, polyvinyl butyral resin, polyether resin, and polyester resin); crosslinkable thermosetting resins (silicone resin, epoxy resin, phenol resin, urea resin, and melamine resin); and photocurable resins (epoxy acrylate and urethane acrylate).

The electrophotographic photosensitive member of the present disclosure may contain, as needed, various conventionally-known additives (e.g., antidegradant (antioxidant, radical scavenger, singlet quencher, or ultraviolet absorbing agent), softener, plasticizer, surface modifier, extender, thickener, dispersion stabilizer, wax, acceptor, or donor) within a range not impairing the effect of the present disclosure. In addition, in order to improve the sensitivity of the photosensitive layer, a known sensitizer (e.g., terphenyl, halonaphthoquinones or acenaphthylene) may be used in combination with the charge generating material.

The contents of the terphenoquinone derivative represented by the formula (1), the charge generating material, the hole transport material, and the binder resin in the electrophotographic photosensitive member of the present disclosure are not particularly limited and can be determined as appropriate. Specifically, the content of the terphenoquinone derivative is preferably 5 parts by mass or more and 100 parts by mass or less, and more preferably 10 parts by mass or more and 80 parts by mass or less with respect to 100 parts by mass of the binder resin. When the content of the terphenoquinone derivative is 5 parts by mass or more, desired photosensitive characteristics are sufficiently exhibited. When the content of the terphenoquinone derivative is 100 parts by mass or less, the photosensitive characteristics do not become saturated, providing a cost advantage.

The content of the charge generating material is preferably 0.1 parts by mass or more and 50 parts by mass or less, and more preferably 0.5 parts by mass or more and 30 parts by mass or less with respect to 100 parts by mass of the binder resin. When the content of the charge generating material is 0.1 parts by mass or more, desired photosensitive characteristics are sufficiently exhibited. When the content of the charge generating material is 50 parts by mass or less, the photosensitive characteristics do not become saturated, providing a cost advantage.

The content of the hole transport material is preferably 5 parts by mass or more and 500 parts by mass or less, and more preferably 25 parts by mass or more and 200 parts by mass or less with respect to 100 parts by mass of the binder resin. When the content of the hole transport material is 5 parts by mass or more, desired photosensitive characteristics are sufficiently exhibited. When the content of the hole transport material is 500 parts by mass or less, the photosensitive characteristics do not become saturated, providing a cost advantage.

The thickness of the photosensitive layer of the electrophotographic photosensitive member (total thickness of the charge generating layer and the charge transport layer in the case of the multi-layer photosensitive member) is not particularly limited as long as the photosensitive layer can produce a sufficient effect. The photosensitive layer has a thickness of preferably 5 μm or more and 100 μm or less, and more preferably 10 μm or more and 50 μm or less, for example.

Next, an example of a method for producing the electrophotographic photosensitive member will be described.

First, for producing the electrophotographic photosensitive member of the present disclosure, an application liquid is prepared by dissolving or dispersing in a solvent the terphenoquinone derivative, a charge generating material, a hole transport material, a binder resin, and one or more additives as needed. Then, the application liquid is applied to a conductive substrate by an appropriate application method and dried to produce the electrophotographic photosensitive member. The application method is not particularly limited, and examples thereof include dip coating. In the case of the production of the multi-layer photosensitive member, for example, an application liquid for charge generating layer formation (an application liquid obtained by dissolving or dispersing in a solvent a charge generating material, a binder resin, and one or more additives as needed) and an application liquid for charge transport layer formation (an application liquid obtained by dissolving or dispersing in a solvent a charge transport material, a binder resin, and one or more additives as needed) are prepared. Then, one of the application liquid for charge generating layer formation and the application liquid for charge transport layer formation is applied to a conductive substrate and dried to form a corresponding one of the charge generating layer and the charge transport layer. Thereafter, the other application liquid is applied to the charge generating layer or the charge transport layer formed on the conductive substrate and dried to form the other layer.

The solvents to be used for the application liquids are not particularly limited as long as the components to be contained in the application liquids can be dissolved or dispersed therein. Examples of the solvents include alcohols (methanol, ethanol, isopropanol, or butanol); aliphatic hydrocarbons (n-hexane, octane, or cyclohexane); aromatic hydrocarbons (benzene, toluene, or xylene); halogenated hydrocarbons (dichloromethane, dichloroethane, carbon tetrachloride, or chlorobenzene); ethers (dimethyl ether, diethyl ether, tetrahydrofuran, ethylene glycol dimethyl ether, or diethylene glycol dimethyl ether); ketones (acetone, methyl ethyl ketone, or cylohexanone); esters (ethyl acetate or methyl acetate); dimethylformaldehyde; dimethylformamide; and dimethyl sulfoxide. These solvents may be used alone, or two or more of these solvents may be used in combination.

The above-described electrophotographic photosensitive member can be used as an image bearing member, for example, in an electrographic image forming apparatus. It is therefore possible to form higher-quality images and reduce damage in the photosensitive layer of the electrophotographic photosensitive member.

[Image Forming Apparatus]

An image forming apparatus of the present disclosure includes the above-described electrophotographic photosensitive member of the present disclosure. The image forming apparatus of the present disclosure is not particularly limited as long as it is an electrographic image forming apparatus.

The image forming apparatus of the present disclosure may be a tandem color image forming apparatus in order to form toner images of different colors of toners. The tandem color image forming apparatus includes a plurality of image bearing members arranged side by side in a predetermined direction and a plurality of developing devices. The developing devices each include a developing roller. The developing rollers are disposed to face the respective image bearing members and each carry toner on its surface to supply the toner to the surface of the corresponding image bearing member. The above-described electrophotographic photosensitive member containing the specific terphenoquinone derivative may be used as the image bearing member.

Figure 2:
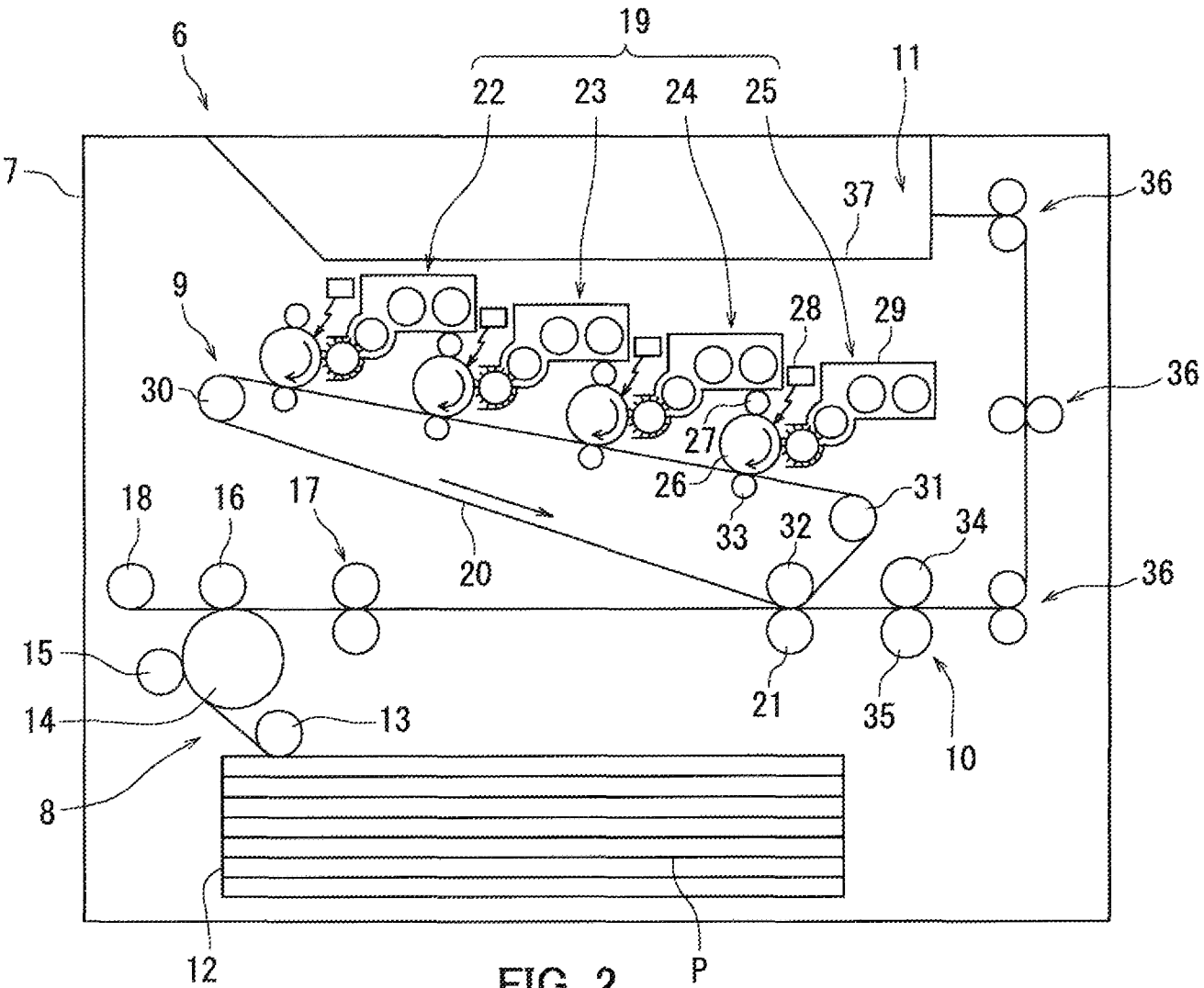
FIG. 2 is a schematic cross sectional view showing a configuration of an image forming apparatus including the electrophotographic photosensitive member of the present disclosure.

FIG. 2 is a schematic view showing an example of the configuration of the image forming apparatus of the present embodiment. The image forming apparatus of the present embodiment will be described on the assumption that an image forming apparatus 6 in FIG. 2 is a color printer.

The image forming apparatus 6 has a boxlike main body 7 as shown in FIG. 2. The main body 7 houses therein a paper feed section 8, an image forming section 9, and a fixing section 10. The paper feed section 8 feeds paper P. The image forming section 9 transfers a toner image based on image data to the paper P, while conveying the paper P fed from the paper feed section 8. The fixing section 10 is for performing a fixing process. More specifically, the fixing section 10 fixes an unfixed toner image, which has been transferred to the paper P by the image forming section 9, to the paper P. A paper ejecting section 11 is provided on the upper surface of the main body 7. The paper ejecting section 11 receives the paper P ejected after being subjected to the fixing process by the fixing section 10.

The paper feed section 8 includes a paper feed cassette 12, a pickup roller 13, paper feed rollers 14, 15, and 16, and registration rollers 17. The paper feed cassette 12 is detachably provided to the main body 7 and accommodates paper P of various sizes. The pickup roller 13 is disposed at a location above the paper feed cassette 12 and picks up the paper P loaded in the paper feed cassette 12 sheet by sheet. The paper feed rollers 14, 15, and 16 convey the paper P picked up by the pickup roller 13. The registration rollers 17 feed the paper P conveyed by the paper feed rollers 14, 15, and 16 to the image forming section 9 with a predetermined timing after temporarily holding the paper P in standby.

The paper feed section 8 further includes a manual feed tray (not shown) to be attached to the left side of the main body 7 and a pickup roller 18 as shown in FIG. 2. The pickup roller 18 picks up the paper P loaded on the manual feed tray. The paper P picked up by the pickup roller 18 is conveyed by the paper feed rollers 14, 15, and 16. The paper P is then fed to the image forming section 9 with a predetermined timing by the registration rollers 17.

The image forming section 9 includes an image forming unit 19, an intermediate transfer belt 20, and a secondary transfer roller 21. The intermediate transfer belt 20 primarily transfers a toner image based on image data. The image data is transmitted by the image forming unit 19 from a computer or the like to a surface (contact surface) of the intermediate transfer belt 20. The secondary transfer roller 21 secondarily transfers the toner image on the intermediate transfer belt 20 to the paper P fed from the paper feed cassette 12.

The image forming unit 19 includes a black toner supplying unit 22, a yellow toner supplying unit 23, a cyan toner supplying unit 24, and a magenta toner supplying unit 25 disposed in the stated order from the upstream side (from the right hand side in FIG. 2) to the downstream side. The units 22, 23, 24, and 25 each include, as an image bearing member, a photosensitive drum 26 disposed centrally of the corresponding unit to be rotatable in the arrowed direction (clockwise).

Furthermore, a charger 27, an exposure device 28, a developing device 29, and a cleaning device (not shown), and a static eliminator (not shown) are disposed around each photosensitive drum 26 in the stated order from the upstream side in the rotation direction of the drum. The static eliminator functions as a static eliminating section in the present disclosure. The above-described electrophotographic photosensitive member of the present disclosure is used as each photosensitive drum 26.

The charger 27 uniformly charges the peripheral surface of the corresponding photosensitive drum 26 rotating in the arrowed direction. The charger 27 may be a charger including a charging roller in contact with the surface of the corresponding image bearing member, for example.

The charging roller may be a roller having a surface made of a resin, for example. More specifically, the charging roller may include, for example, a core bar supported to be axially rotatable, a resin layer formed on the core bar, and a voltage application section for applying a voltage to the core bar. The charger including such a charging roller charges the surface of the photosensitive drum 26 in contact with the charging roller via the resin layer.

The resin forming the resin layer is not particularly limited. Examples of the resin include silicone resins, urethane resins, and silicone modified resins. The resin layer may contain an inorganic filler.

The exposure device 28 is a so-called laser scanning unit. According to image data input from a personal computer being a higher-order device, the exposure device 28 emits a laser beam to the peripheral surface of the corresponding photosensitive drum 26 uniformly charged by the charger 27. Thus, an electrostatic latent image based on the image data is formed on the photosensitive drum 26.

The developing device 29 supplies toner to the peripheral surface of the corresponding photosensitive drum 26 on which the electrostatic latent image has been formed. Thus, a toner image based on the image data is formed. The toner image is then primarily transferred to the intermediate transfer belt 20. The cleaning device cleans toner remaining on the peripheral surface of the corresponding photosensitive drum 26 after the completion of the primary transfer of the toner image to the intermediate transfer belt 20. The static eliminator eliminates the charges on the peripheral surface of the corresponding photosensitive drum 26 after the completion of the primary transfer of the toner image to the intermediate transfer belt 20. The peripheral surface of the photosensitive drum 26 cleaned by the cleaning device and the static eliminator then comes to the charger to be newly charged.

The intermediate transfer belt 20 is a rotatory body in the shape of an endless belt. The intermediate transfer belt 20 is wound around a plurality of rollers (i.e., a drive roller 30, a driven roller 31, a backup roller 32, and primary transfer rollers 33) such that the surface (contact surface) of the intermediate transfer belt 20 is in contact with the peripheral surfaces of the respective photosensitive drums 26.

The intermediate transfer belt 20 is pressed against the photosensitive drums 26 by the primary transfer rollers 33 disposed to face the respective photosensitive drums 26. As the rollers rotate, the intermediate transfer belt 20 rotates while being pressed against the photosensitive drums 26. The drive roller 30 is driven and rotated by a drive source (e.g., a stepping motor) to rotate the intermediate transfer belt 20. The driven roller 31, the backup roller 32, and the primary transfer rollers 33 are rotatably provided, and are driven and rotated by the rotation of the intermediate transfer belt 20 driven by the drive roller 30. The driven roller 31, the backup roller 32, and the primary transfer rollers 33 are driven and rotated by the active rotation of the drive roller 30 via the intermediate transfer belt 20 and support the intermediate transfer belt 20.

The intermediate transfer belt 20 is driven by the drive roller 30 to rotate in the arrowed direction (counterclockwise) between the photosensitive drums 26 and the primary transfer rollers 33. The primary transfer rollers 33 apply primary transfer bias (of a polarity opposite to the charging polarity of toner) to the intermediate transfer belt 20. Accordingly, the toner images formed on the respective photosensitive drums 26 are transferred (primarily transferred) to the intermediate transfer belt 20 in sequence.

The secondary transfer roller 21 applies secondary transfer bias (of a polarity opposite to the charging polarity of the toner images) to the paper P. As a result, the toner images primarily transferred to the intermediate transfer belt 20 are transferred to the paper P at a position between the secondary transfer roller 21 and the backup roller 32. Thus, a color image (unfixed toner images) is transferred to the paper P.

The fixing section 10 fixes the color image (unfixed toner images) transferred to the paper P in the image forming section 9. The fixing section 10 includes a pressure roller 35 and a heating roller 34 that is heated by a conductive heating element. The pressure roller 35 is disposed to face the heating roller 34. The peripheral surface of the pressure roller 35 is pressed into contact with the peripheral surface of the heating roller 34.

The image transferred to the paper P by the secondary transfer roller 21 in the image forming section 9 is fixed to the paper P through the fixing by heat applied during the time when the paper P passes between the heating roller 34 and the pressure roller 35. The paper P after the fixing is ejected to the paper ejecting section 11. A plurality of conveyance rollers 36 are disposed at appropriate locations between the fixing section 9 and the paper ejecting section 11.

The paper ejecting section 11 is formed in a fashion that a top portion of the main body 7 is recessed. The paper ejecting section 11 has an exit tray 37. The exit tray 37 receives the ejected paper P at the bottom of the recess.

The image forming apparatus 6 of the present disclosure forms an image on the paper P as described above. In the case of the tandem color image forming apparatus as above, the electrophotographic photosensitive member of the present disclosure is included as each image bearing member. It is therefore possible to form higher-quality images and reduce damage in the photosensitive layer of the electrophotographic photosensitive member.

EXAMPLES

The following more specifically describes the present disclosure by way of examples. It should be noted that the present disclosure is in no way limited by the examples.

Synthesis of Terphenoquinone Derivative

Synthesis Example 1

A terphenoquinone derivative represented by the following formula (1-1) was synthesized according to following Reaction Formulae (V) to (VIII).

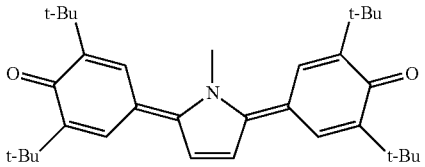

(1-1)

Reaction Formula (V)

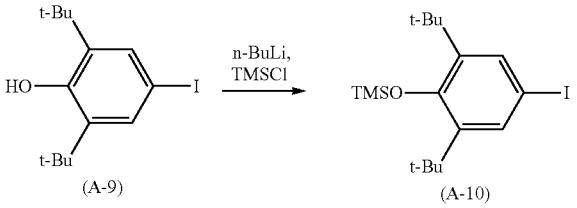

Reaction Formula (VI)

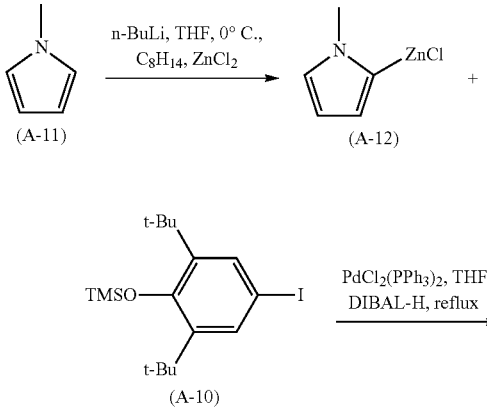

-continued

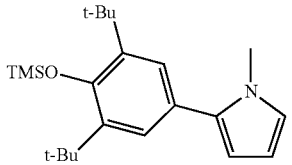

Reaction Formula (VII)

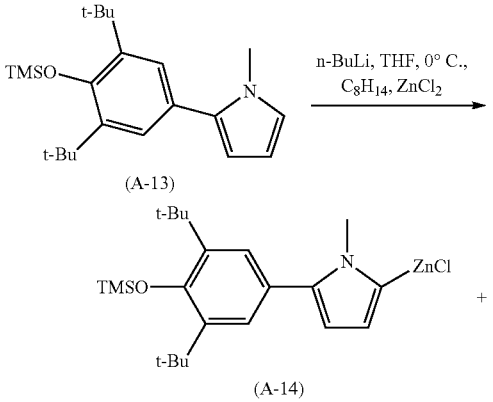

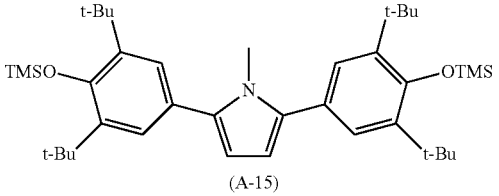

Reaction Formula (VIII)

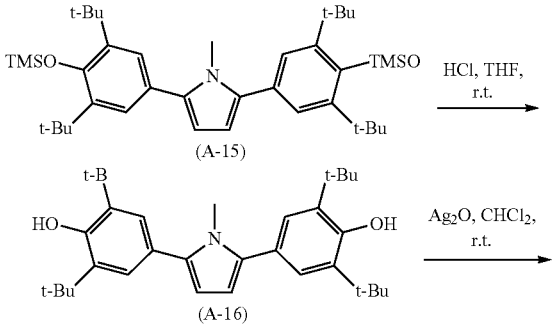

-continued

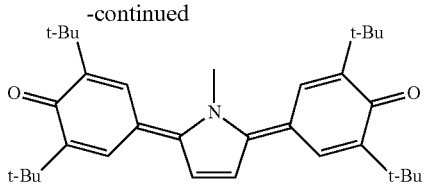

(I-1)

In Reaction Formula (V), a tetrahydrofuran (THF) solution of 6.7 g (20 mmol) of 4-iodo-2,6-di-t-butylphenol (A-9) was cooled to 20° C., and 13 ml (21 mmol) of a 1.6 M hexane solution of n-BuLi was added to the tetrahydrofuran solution under a nitrogen atmosphere. Furthermore, trimethylsilylchloride (TMSCl) was added to the solution to give 3.6 g of 4-iodo-2,6-di-t-butylphenol (A-10) (yield: 45%) in which a hydroxyl group is protected with a trimethylsilyl group (TMS).

In Reaction Formula (VI), a THF solution of a compound (A-11) (340 mg, 4.2 mmol) was cooled to 0° C., and 2.8 mL (4.2 mmol) of a 1.6 M hexane solution of n-BuLi was added to the THF solution under a nitrogen atmosphere. Then, 0.6 g (4.2 mmol) of zinc chloride was further added to the solution. Thus, a THF solution of a compound (A-12) was obtained. Meanwhile, 0.5 mL (0.5 mmol) of a 1.0 M hexane solution of diisobutylaluminum hydride (DIBAL-H) was added to a THF solution of 150 mg of a bistriphenylphosphine-palladium chloride complex [$PdCl_2(PPh_3)_2$] in another reaction vessel to produce zero-valent palladium as an activated species. The compound (A-12) and the compound (A-10) (1.7 g, 42 mmol) were added to the reaction vessel, and the mixture was reacted under reflux for 2 hours. After the completion of the reaction, the reaction product was put in water, and extracted with and recrystallized from chloroform to give a compound (A-13).

Next, in Reaction Formula (VII), 2.8 mL (4.2 mmol) of a 1.6M hexane solution of n-BuLi was added to a THF solution of the compound (A-13) at 0° C. under a nitrogen atmosphere. Furthermore, 0.6 g (4.2 mmol) of zinc chloride was added to the solution to give a THF solution of a compound (A-14). Zero-valent palladium as an activated species was produced in the same manner as in Reaction Formula (VI). Subsequently, the compound (A-14) and the compound (A-10) were added to the reaction vessel, and the mixture was reacted under reflux and stirring for 2 hours. After the completion of the reaction, the reaction product was put in water, and extracted with and recrystallized from chloroform to give a compound (A-15).

Figure 3:
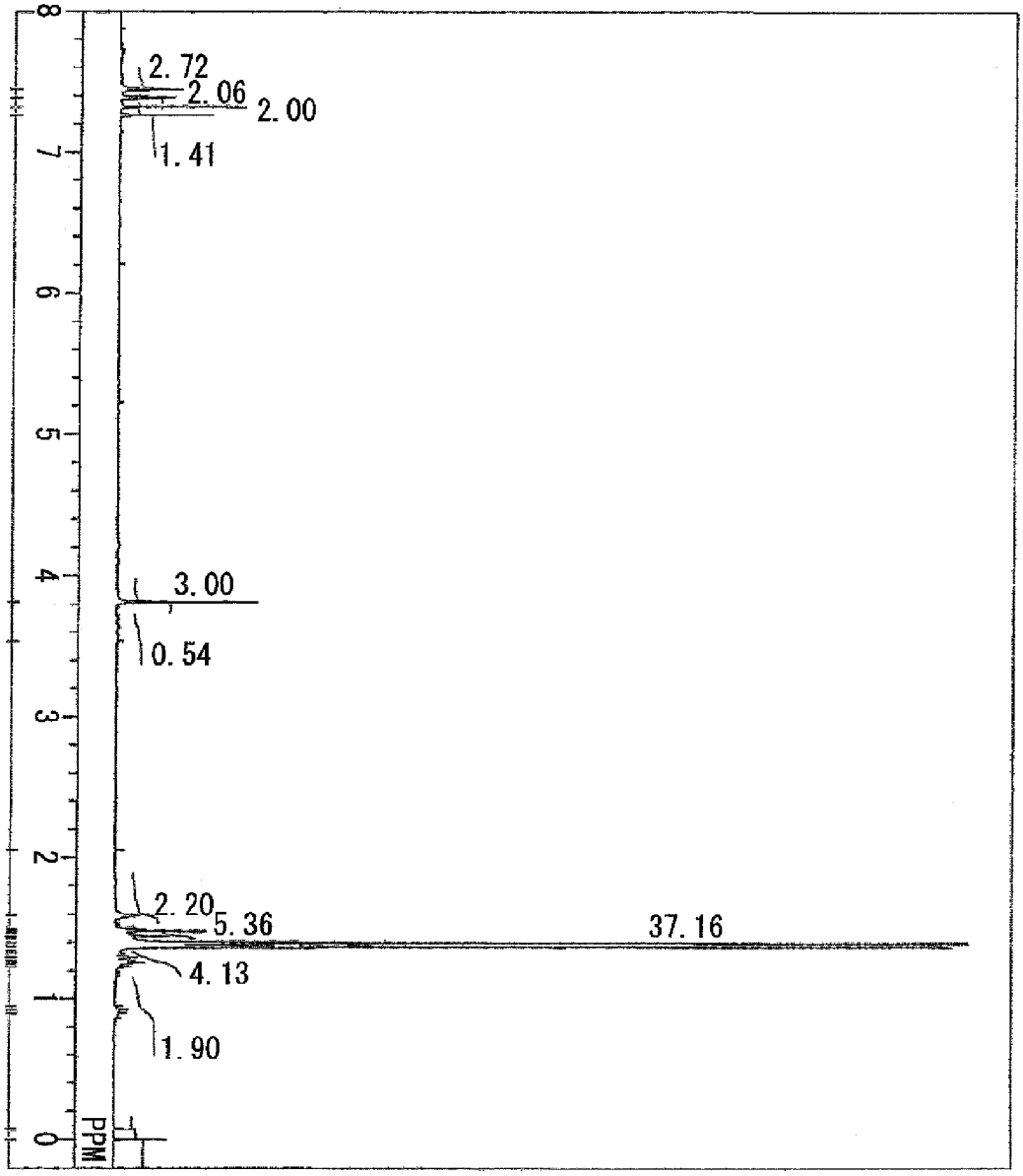
FIG. 3 is a $^1$H-NMR spectrum of a terphenoquinone derivative obtained in Synthesis Example 1.

Next, in Reaction Formula (VIII), an excess amount of concentrated sulfuric acid was added dropwise to a mixed solution obtained by dissolving the compound (A-15) in a mixed solvent of THF and water, followed by stirring for several hours. Thereafter, the resultant product was put in water, extracted with chloroform, and dried for solvent elimination to give a crude product (A-16). Furthermore, an excess amount of silver oxide was added to a chloroform solution of the crude product (A-16) to oxidize the crude product (A-16). After the completion of the oxidation reaction, the product was collected by filtration and purified by a silica gel column (chloroform/hexane=1/1). Subsequently, the product was recrystallized from chloroform to give purple crystals. A $^1$H-NMR spectrum (300 MHz, $CDCl_3$) of the crystals is shown in FIG. 3. Based on FIG. 3, the thus obtained crystals were confirmed to be the terphenoquinone derivative represented by the formula (1-1). The terphenoquinone derivative was obtained in an amount of 0.41 g and in 20% yield.

Synthesis Example 2

A terphenoquinone derivative represented by the following formula (1-2) in an amount of 0.48 g was obtained (yield: 15%, purple crystals) in the same manner as in Synthesis Example 1 except that the compound (A-9) was changed to a compound (A-17), and 1.34 g (4.2 mmol) of a compound (A-18) was synthesized and used instead of the compound (A-10) in Reaction Formula (V).

(A-17)

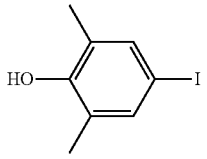

(A-18)

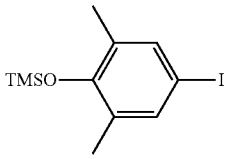

(1-2)

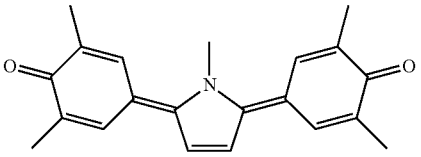

Synthesis Example 3

A terphenoquinone derivative represented by the formula (1-3) in an amount of 0.50 g was obtained (yield: 15%, purple crystals) in the same manner as in Synthesis Example 2 except that the compound (A-11) was changed to 399 mg (4.2 mmol) of a compound (A-19) in Reaction Formula (VI).

(A-19)

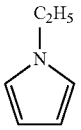

(1-3)

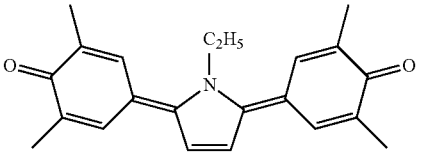

Synthesis Example 4

A terphenoquinone derivative represented by the formula (1-4) in an amount of 0.42 g was obtained (yield: 10%, purple crystals) in the same manner as in Synthesis Example 2 except that the compound (A-11) was changed to 752 mg (4.2 mmol) of a compound (A-20) in Reaction Formula (VI).

(A-20)

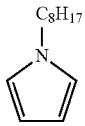

(1-4)

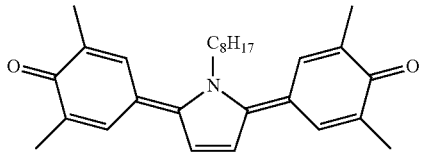

Synthesis Example 5

A terphenoquinone derivative represented by the formula (1-5) in an amount of 0.55 g was obtained (yield: 10%, purple crystals) in the same manner as in Synthesis Example 1 except that the compound (A-11) was changed to 601 mg (4.2 mmol) of a compound (A-21) in Reaction Formula (VI).

(A-21)

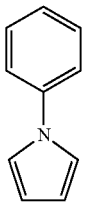

(1-5)

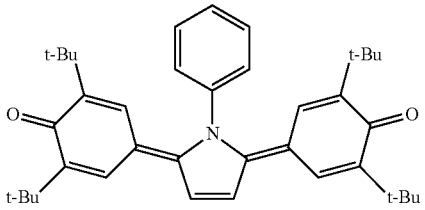

Synthesis Example 6

A terphenoquinone derivative represented by the formula (1-6) in an amount of 0.84 g was obtained (yield: 15%, purple crystals) in the same manner as in Synthesis Example 1 except that the compound (A-11) was changed to 659 mg (4.2 mmol) of a compound (A-22) in Reaction Formula (VI).

(A-22)

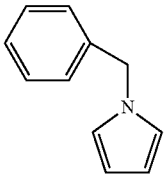

-continued (1-6)

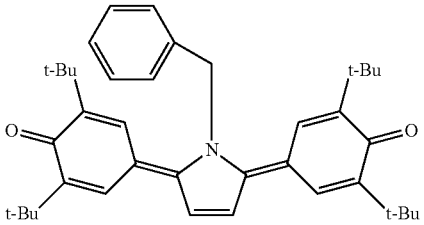

Synthesis Example 7

A terphenoquinone derivative represented by the formula (1-7) in an amount of 0.39 g was obtained (yield: 10%, purple crystals) in the same manner as in Synthesis Example 2 except that the compound (A-11) was changed to 626 mg (4.2 mmol) of a compound (A-23) in Reaction Formula (VI).

(A-23)

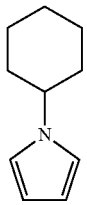

(1-7)

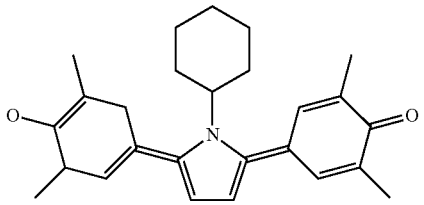

Synthesis Example 8

A terphenoquinone derivative represented by the formula (1-8) in an amount of 0.34 g was obtained (yield: 10%, purple crystals) in the same manner as in Synthesis Example 2 except that the compound (A-11) was changed to 407 mg (4.2 mmol) of a compound (A-24) in Reaction Formula (VI).

(A-24)

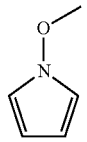

(1-8)

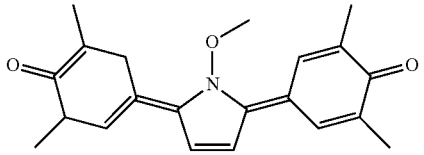

Production of Electrophotographic Photosensitive Member

Example 1

Five (5) parts by mass of an X-form metal-free phthalocyanine (X—$H_2$Pc) represented by the formula (C-1) as a charge generating material, 50 parts by mass of a benzidine derivative represented by the formula (H-1) as a hole transport material, 30 parts by mass of the terphenoquinone derivative represented by the formula (1-1) obtained in Synthesis Example 1 as an electron transport material, and 100 parts by mass of a polycarbonate resin as a binder resin were added to 800 parts by mass of tetrahydrofuran as a solvent. The added was mixed and dispersed using a ball mill for 50 hours to give an application liquid for photosensitive layer formation.

(C-1)

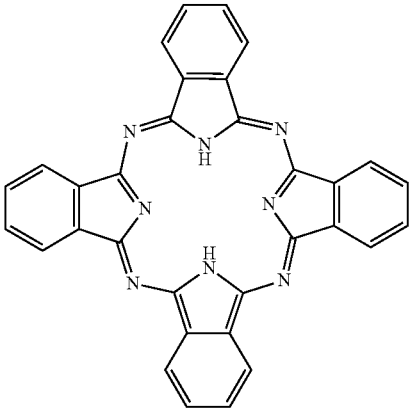

(H-1)

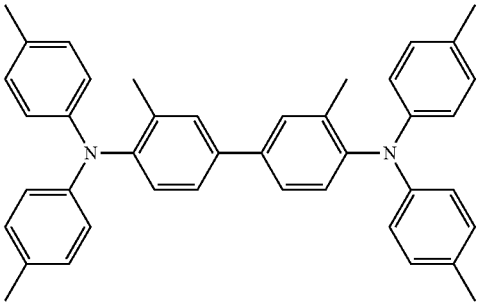

The application liquid was applied to a conductive substrate made from an aluminum tube by dip coating. Subsequently, the application liquid applied was hot-air-dried at 100° C. for 60 minutes to give an electrophotographic photosensitive member of Example 1. A photosensitive layer (single-layer photosensitive layer) having a thickness of 30 μm was formed on the conductive substrate in the electrophotographic photosensitive member of Example 1.

Example 2

An electrophotographic photosensitive member of Example 2 was obtained in the same manner as in Example 1 except that instead of the X—$H_2$Pc represented by the formula (C-1), the same amount of a Y-form titanyl phthalocyanine (Y—TiOPc) represented by the formula (C-2) was used as a charge generating material.

(C-2)

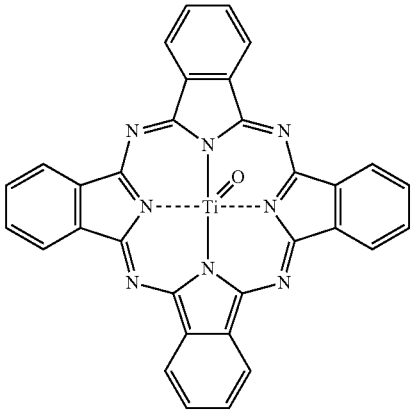

Example 3

An electrophotographic photosensitive member of Example 3 was obtained in the same manner as in Example 1 except that instead of the terphenoquinone derivative represented by the formula (1-1), the same amount of the terphenoquinone derivative represented by the formula (1-2) obtained in Synthesis Example 2 was used as an electron transport material.

Example 4

An electrophotographic photosensitive member of Example 4 was obtained in the same manner as in Example 3 except that instead of the X—$H_2$Pc represented by the formula (C-1), the same amount of the Y—TiOPc represented by the formula (C-2) was used as a charge generating material.

Example 5

An electrophotographic photosensitive member of Example 5 was obtained in the same manner as in Example 1 except that instead of the terphenoquinone derivative represented by the formula (1-1), the same amount of the terphenoquinone derivative represented by the formula (1-3) obtained in Synthesis Example 3 was used as an electron transport material.

Example 6

An electrophotographic photosensitive member of Example 6 was obtained in the same manner as in Example 5 except that instead of the X—$H_2$Pc represented by the formula (C-1), the same amount of the Y—TiOPc represented by the formula (C-2) was used as a charge generating material.

Example 7

An electrophotographic photosensitive member of Example 7 was obtained in the same manner as in Example 1 except that instead of the terphenoquinone derivative represented by the formula (1-1), the same amount of the terphenoquinone derivative represented by the formula (1-4) obtained in Synthesis Example 4 was used as an electron transport material.

Example 8

An electrophotographic photosensitive member of Example 8 was obtained in the same manner as in Example 7 except that instead of the X—$H_2$Pc represented by the formula (C-1), the same amount of the Y—TiOPc represented by the formula (C-2) was used as a charge generating material.

Example 9

An electrophotographic photosensitive member of Example 9 was obtained in the same manner as in Example 1 except that instead of the terphenoquinone derivative represented by the formula (1-1), the same amount of the terphenoquinone derivative represented by the formula (1-5) obtained in Synthesis Example 5 was used as an electron transport material.

Example 10

An electrophotographic photosensitive member of Example 10 was obtained in the same manner as in Example 9 except that instead of the X—$H_2$Pc represented by the formula (C-1), the same amount of the Y—TiOPc represented by the formula (C-2) was used as a charge generating material.

Example 11

An electrophotographic photosensitive member of Example 11 was obtained in the same manner as in Example 1 except that instead of the terphenoquinone derivative represented by the formula (1-1), the same amount of the terphenoquinone derivative represented by the formula (1-6) obtained in Synthesis Example 6 was used as an electron transport material.

Example 12

An electrophotographic photosensitive member of Example 12 was obtained in the same manner as in Example 11 except that instead of the X—$H_2$Pc represented by the formula (C-1), the same amount of the Y—TiOPc represented by the formula (C-2) was used as a charge generating material.

Example 13

An electrophotographic photosensitive member of Example 13 was obtained in the same manner as in Example 1 except that instead of the terphenoquinone derivative represented by the formula (1-1), the same amount of the terphenoquinone derivative represented by the formula (1-7) obtained in Synthesis Example 7 was used as an electron transport material.

Example 14

An electrophotographic photosensitive member of Example 14 was obtained in the same manner as in Example 13 except that instead of the X—$H_2$Pc represented by the formula (C-1), the same amount of the Y—TiOPc represented by the formula (C-2) was used as a charge generating material.

Comparative Example 1

An electrophotographic photosensitive member of Comparative Example 1 was obtained in the same manner as in Example 1 except that instead of the terphenoquinone derivative represented by the formula (1-1), the same amount of a compound represented by the formula (E-1) was used as an electron transport material.

(E-1)

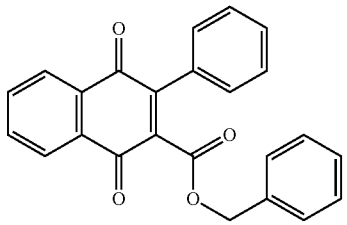

Comparative Example 2

An electrophotographic photosensitive member of Comparative Example 2 was obtained in the same manner as in Comparative Example 1 except that instead of the X—$H_2$Pc represented by the formula (C-1), the same amount of the Y—TiOPc represented by the formula (C-2) was used as a charge generating material.

Comparative Example 3

An electrophotographic photosensitive member of Comparative Example 3 was obtained in the same manner as in Example 1 except that instead of the terphenoquinone derivative represented by the formula (1-1), the same amount of the terphenoquinone derivative represented by the formula (1-8) obtained in Synthesis Example 8 was used as an electron transport material.

Comparative Example 4

An electrophotographic photosensitive member of Comparative Example 4 was obtained in the same manner as in Comparative Example 3 except that instead of the X—$H_2$Pc represented by the formula (C-1), the same amount of the Y—TiOPc represented by the formula (C-2) was used as a charge generating material.

Comparative Example 5

An electrophotographic photosensitive member of Comparative Example 5 was obtained in the same manner as in Example 1 except that instead of the terphenoquinone derivative represented by the formula (1-1), the same amount of a derivative represented by the formula (E-2) was used as an electron transport material.

(E-2)

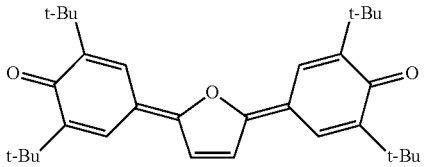

Comparative Example 6

An electrophotographic photosensitive member of Comparative Example 6 was obtained in the same manner as in Example 1 except that instead of the terphenoquinone derivative represented by the formula (1-1), the same amount of a derivative represented by the formula (E-3) was used as an electron transport material.

(E-3)

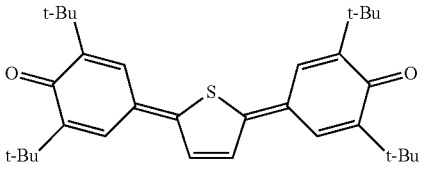

Evaluation of Sensitivity Characteristics

The sensitivity characteristics were evaluated for the electrophotographic photosensitive members obtained in Examples 1 to 14 and Comparative Examples 1 to 4. Each of the electrophotographic photosensitive members was charged to 700 V using a drum sensitivity test device (manufactured by Gentec Inc.) Next, the electrophotographic photosensitive member was irradiated with (exposed to) monochromatic light (wavelength: 780 nm, half-width: 20 nm, and light quantity: 16 $\mu W/cm^2$) extracted by allowing light emitted from a halogen lamp to pass through a bandpass filter (irradiation time: 80 milliseconds). The surface potential (residual potential) was measured after a lapse of 330 milliseconds from the start of the irradiation. The results of the evaluation of the sensitivity characteristics are shown in Table 1.

TABLE 1

| | Materials contained in photosensitive layer | | | |
|---|---|---|---|---|
| | Charge generating material | Hole transport material | Electron transport material | Photosensitivity evaluation (V) |
| Example 1 | C-1 | H-1 | 1-1 | 93 |
| Example 2 | C-2 | H-1 | 1-1 | 87 |
| Example 3 | C-1 | H-1 | 1-2 | 96 |
| Example 4 | C-2 | H-1 | 1-2 | 90 |
| Example 5 | C-1 | H-1 | 1-3 | 97 |
| Example 6 | C-2 | H-1 | 1-3 | 91 |
| Example 7 | C-1 | H-1 | 1-4 | 102 |
| Example 8 | C-2 | H-1 | 1-4 | 95 |
| Example 9 | C-1 | H-1 | 1-5 | 95 |
| Example 10 | C-2 | H-1 | 1-5 | 89 |
| Example 11 | C-1 | H-1 | 1-6 | 100 |
| Example 12 | C-2 | H-1 | 1-6 | 94 |
| Example 13 | C-1 | H-1 | 1-7 | 105 |
| Example 14 | C-2 | H-1 | 1-7 | 100 |
| Comparative Example 1 | C-1 | H-1 | E-1 | 146 |
| Comparative Example 2 | C-2 | H-1 | E-1 | 127 |
| Comparative Example 3 | C-1 | H-1 | 1-8 | Crystallized |
| Comparative Example 4 | C-2 | H-1 | 1-8 | Crystallized |

Evaluation of Crack Resistance

The crack resistance was evaluated for the electrophotographic photosensitive members obtained in Example 1, and Comparative Examples 1, 5, and 6 by the following method. Specifically, random ten areas on the surface of each electrophotographic photosensitive member were selected. The electrophotographic photosensitive member was left to stand for two days after oil (oleic triglyceride) was applied to each of the ten areas. Thereafter, the surfaces of the thus oiled areas of the electrophotographic photosensitive member were observed using an optical microscope. Presence or absence of a crack in the oiled areas was checked by using the microscope and evaluated according to the following criteria.

Good: No crack was observed.

Poor: One or more cracks were observed.

The results of the evaluation of the crack resistance are shown in Table 2.

TABLE 2

| | Materials contained in photosensitive layer | | | |
|---|---|---|---|---|
| | Charge generating material | Hole transport material | Electron transport material | Crack resistance evaluation |
| Example 1 | C-1 | H-1 | 1-1 | Good |
| Comparative Example 1 | C-1 | H-1 | E-1 | Good |
| Comparative Example 5 | C-1 | H-1 | E-2 | Poor |
| Comparative Example 6 | C-1 | H-1 | E-3 | Poor |

As obvious from Table 1, the electrophotographic photosensitive members obtained in Examples 1 to 14 of the present disclosure were all superior in the sensitivity characteristics to the electrophotographic photosensitive members of Comparative Examples 1 and 2. Furthermore, the image forming apparatus of the present disclosure employing any of the electrophotographic photosensitive members obtained in Examples 1 to 14 of the present disclosure was able to form high-quality images. The electrophotographic photosensitive members obtained in Comparative Examples 3 and 4 contained a different terphenoquinone derivative from the terphenoquinone derivative used for the present embodiment. That is, the derivatives of Comparative Examples 3 and 4 had a different substituent at the location of $R^3$ of the derivative of the present embodiment. Accordingly, the terphenoquinone derivatives used in Comparative Examples 3 and 4 had poor compatibility with the binder resin and were found to have been crystallized in the evaluation of the sensitivity characteristics.

As obvious from Table 2, the electrophotographic photosensitive member obtained in Example 1 of the present disclosure was superior in the crack resistance to the electrophotographic photosensitive members obtained in Comparative Examples 5 and 6. This is because the specific terphenoquinone derivative used for the present embodiment (i.e., the terphenoquinone derivative having a pyrrole ring) has better compatibility with the binder resin than terphenoquinone derivatives having a furan ring or a thiophene ring.

What is claimed is:

1. An electrophotographic photosensitive member containing a terphenoquinone derivative represented by the following formula (1):

(1)

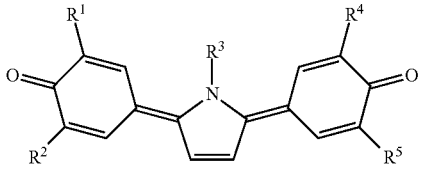

wherein $R^1$ to $R^5$ may be the same or different and each represent a hydrogen atom, an alkyl group having 1 to 12 carbon atoms, an aryl group having 6 to 12 carbon atoms and optionally having an alkyl group having 1 to 12 carbon atoms, an aralkyl group having 6 to 12 carbon atoms, a cycloalkyl group having 3 to 10 carbon atoms, or an alkoxy group having 2 to 6 carbon atoms.

2. An electrophotographic photosensitive member according to claim 1, comprising:

a conductive substrate and a photosensitive layer, the photosensitive layer containing the terphenoquinone derivative represented by the formula (1).

3. An electrophotographic photosensitive member according to claim 2, wherein the photosensitive layer is a single-layer photosensitive layer containing a charge generating material, a hole transport material, an electron transport material, and a binder resin in the same layer, and the electron transport material contains the terphenoquinone derivative represented by the formula (1).

4. An electrophotographic photosensitive member according to claim 1, wherein the $R^1$, $R^2$, $R^4$, and $R^5$ are the same and represent an alkyl group having 1 to 12 carbon atoms.

5. An electrophotographic photosensitive member according to claim 1, wherein the $R^3$ is an alkyl group having 1 to 12 carbon atoms.

6. An electrophotographic photosensitive member according to claim 1, wherein the $R^3$ is one selected from a phenyl group, a benzil group, and a cyclohexyl group.

7. An electrophotographic photosensitive member according to claim 3, wherein a content of the terphenoquinone derivative represented by the formula (1) is 5 parts by mass or more and 100 parts by mass or less with respect to 100 parts by mass of the binder resin.

8. An image forming apparatus, comprising:

an image bearing member;

a charger configured to charge a surface of the image bearing member;

an exposure device configured to expose the surface of the image bearing member charged to form an electrostatic latent image on the surface of the image bearing member;

a developing device configured to develop the electrostatic latent image into a toner image; and a transfer device configured to transfer the toner image from the image bearing member to a material to be transferred, wherein the image bearing member is an electrophotographic photosensitive member according to claim 1.

* * * * *